United States Patent [19]

Green et al.

[11] Patent Number: 4,793,592

[45] Date of Patent: Dec. 27, 1988

[54] PLURAL JACK APPARATUS

[76] Inventors: Charles L. Green; Fran A. Green, both of 909 Pyegrave Pl., Austin, Tex. 78753

[21] Appl. No.: 94,836

[22] Filed: Sep. 10, 1987

[51] Int. Cl.[4] ..... B66F 5/04

[52] U.S. Cl. ..... 254/2 R; 254/134

[58] Field of Search ..... 264/17, 296, 69; 254/2 R, 2 B, 133, 133 A, 134, 89 R, 89 H; 280/638, 659, 79.1 R, 79.1 A; 414/426, 427, 429

[56] References Cited

U.S. PATENT DOCUMENTS

| | | | |
|---|---|---|---|
| 2,568,827 | 9/1951 | Schallock | 254/2 B |
| 2,636,715 | 4/1953 | Griffin | 254/2 B |
| 2,724,572 | 11/1955 | Weinberg | 254/89 H |
| 3,830,470 | 8/1974 | Gibson | 254/133 |
| 3,850,419 | 11/1974 | Craig | 269/17 |
| 3,949,976 | 4/1976 | Cofer | 269/17 |
| 4,123,038 | 10/1978 | Meyers | 254/134 |
| 4,177,978 | 12/1979 | Warsaw | 269/17 |
| 4,383,681 | 5/1983 | Walters | 269/17 |

*Primary Examiner*—Robert C. Watson
*Attorney, Agent, or Firm*—Leon Gilden

[57] ABSTRACT

A mobile jack apparatus is configured to include a plurality of jacks positioned on a mobile telescoping support structure forwardly and rearwardly thereof. Jacks have selectively positionable thereon a variety of adjuncts enabling the aforenoted jacks to accommodate a variety of mechanical configurations. A central jack is selectively positionable within a housing structure on a forward medially portion of the rear portion of the telescoping support structure for optional use in accommodating various mechanical objects.

5 Claims, 1 Drawing Sheet

PLURAL JACK APPARATUS

BACKGROUND OF THE INVENTION

1. Field of the Invention

The present invention relates to jack support devices, and more particularly to a new and improved jack support device which, provides a plurality of jacks on a telescoping support structure enabling accommodation of a wide variety of mechanical objects.

2. Description of the prior Art

The use of jack support structures is well known in the prior art. As may be appreciated, these devices usually have required design and application for a relatively narrow use when applied to a particular class of mechanical objects to be supported. In this connection, there have been several attempts to developed jack support structure which may be effectively and readily accommodated to a wide variety of mechanical objects to be supported. For example, U.S. Pat. No. 1,214,288 to Wetzel illustrates a conventional screw jack provided with a top support plate which has associated spur thereon vertically adjustable and thereby positionable above or below the surface of said plate. As an early attempt to provide a jack of multiple applicability, the Wetzel patent is illustrative thereof.

U.S. Pat. No. 1,796,173 to Warren sets forth a telescoping jack utilized with various caps in a effort to provide accommodation for particular use such as automobile repair shops and garages. This particular jack organization is not particularly suitable for mobility or provision for plural telescoping jacks sites.

U.S. Pat. No. 2,908,258 to Jovanovich sets forth a support stand structure with a plurality of support elements thereon and adaptable for use with conventional floor jacks. The positioning of the support stand in relation to a floor jack limits its stability and fails to provide for plural jacking points for positioning of a range of particular mechanical objects.

U.S. Pat. No. 2,926,888 to Schultz illustrates a hydraulic service jack positioned on a mobile stand provided with a single lift support point for use therewith. This Schultz patent is limiting in adaptability and application due to the single support jack and the extreme overall height of the jack rendering it suitable for broad range access to a motor vehicle.

U.S. Pat. No. 3,802,658 to Binding illustrates a jack stand organization of application for use with jacks and particular support locks therealong. This organization is cited for its calm locking feature but is again of limited applicability in a plural lifting arrangements, as required by my invention.

Similarly, U.S. Pat. No. 4,330,104 to Clok provides a hydraulic jack with a unique triangulated stand arrangement. While the uniqueness of the particular jacking organization is interesting but as in the previously cited art, fails to provide a plural jacking support organization for accommodating the bulky and awkward mechanical objects often associated with such jacks such as in automotive repair shops.

As such it may be appreciated that there is continuing need for a new and improved jack support apparatus which addresses both the problem of mobility and multiple point support ability of mechanical objects, and in this respect, the present invention essentially fulfills this need,

SUMMARY OF THE INVENTION

In view of the foregoing disadvantages inherent in the known types of jack support apparatus now present in the prior art, the present invention provides an improved plural jack apparatus wherein plural jack support lift points are positioned on a telescoping mobile base structure. As such, the general purpose of the present invention which will be described subsequently in greater detail, is to provide a new and improved plural jack apparatus which has all the advantages of the prior art jack support structure and none of the disadvantages.

To attain this, the present invention comprises a mobile support base which is positionable as desired on a support surface. The mobile support base's telescoping capacity enables a lengthening or shortening of the bas to accommodate a size range of mechanical object to be supported. The telescoping base may be locked in a desired position and selective ones of a plurality of jacks may be positioned on the base along with cooperating support heads configured to accommodate a variety of mechanical objects.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present& invention. It is important, therefore, that the claims be regarded as including such equivalent constructions insofar as they do not depart from the spirit and scope of the present invention.

Further, the purpose of the foregoing abstract is of enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved plural jack apparatus which has all the advantages of the prior art plural jack apparatus and none of the disadvantages.

It is another object of the present invention to provide a new and improved plural jack apparatus which may be easily and efficiently manufactured and marketed.

It is a further object of the present invention to provide a new and improved plural jack apparatus which is of a durable and reliable construction.

An even further object of the present invention is to provide a new and improved plural jack apparatus which is susceptible of a low cost of manufacture with regard to both materials and labor, and which accordingly is then susceptible of low prices of sale to the consuming public, thereby making such plural jack apparatuses economically available to the buying public.

Still yet another object of the present invention is to provide a new and improved plural jack apparatus which provides in the apparatuses and methods of the prior art some of the advantages thereof, while simultaneously overcoming some of the disadvantages normally associated therewith.

Still another object of the present invention is to provide a new and improved plural jack apparatus formed with a mobile telescoping base.

Yet another object of the present invention is to provide a new and improved plural jack apparatus Wherein plural jacking members are providable with variously configured support heads for support of a variety of mechanical objects.

These together with other objects of the invention along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
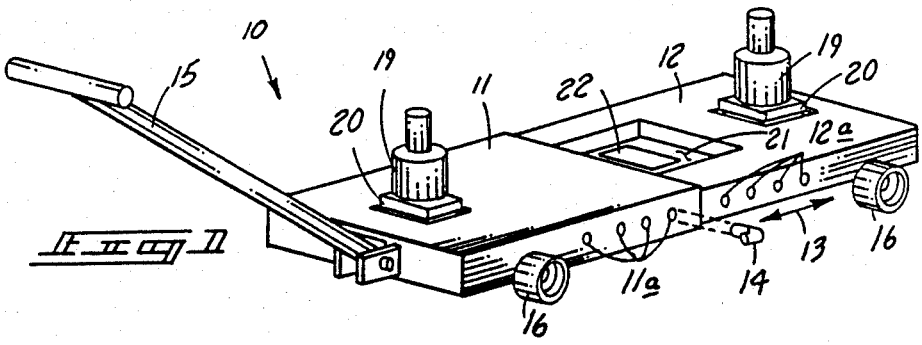
FIG. 1 is an isometric view of the plural jack apparatus comprising the present invention.

With reference now to the drawings, and in particular to FIG. 1 thereof, a new and improved plural jack apparatus embodying the principles and concepts of the present invention and generally designated by the reference numeral 10 will be described.

More specifically, it will be noted that the plural jack apparatus 10 is formed of a forward support base 11 and a telescoping rearward support base 12 selectively positionable therein, as indicated by arrow 13. The positioning of rearward portion 12 relative to forward support base 11 is accomplished by use of aligning forward alignment openings 11*a* with rearward alignment openings 12*a* and thereupon positioning detent pin 14 therethrough to secure the forward and rearward support base members in a desired pre-selected positioning relative to one another. Wheels 16 are secured at forward positions relative to jack apparatus 10, as best illustrated in FIG. 2, and the apparatus is maneuverable and manipulatable by means of forwardly extending handle 15.

A forward jack support recess 17 is positioned at a forward distal portion of support base 11 and accordingly a rearward jack support recess 18 is similarly located at a rearward medial position on rearward support base 12. Hydraulic jacking members 19 are positionable within respective recesses 17 and 18 by a complementary flange 20 of complementary shape to recesses 17 and 18 to position jacks 19 in a secure manner within said recesses.

Figure 2:
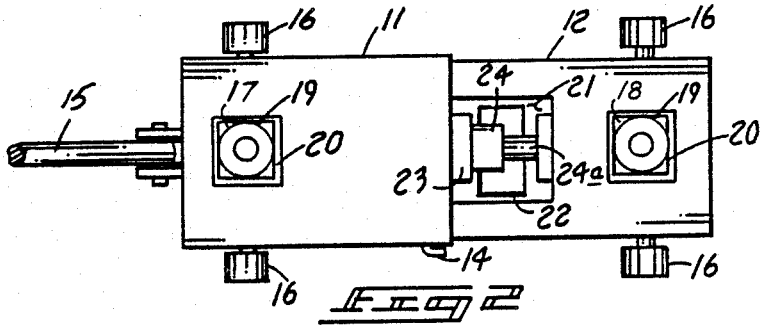
FIG. 2 is a top orthographic view of the plural jack apparatus comprising the present invention.
Figure 3:
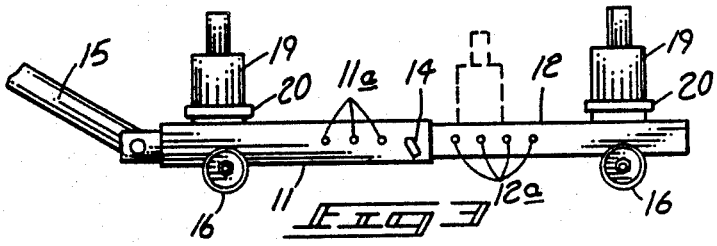
FIG. 3 is a side orthographic view of the present invention illustrating a plurality of jacks supported thereon.
Figure 4:
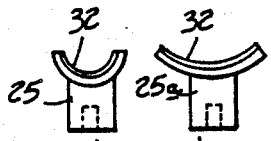
FIGS. 4, 5, 6, 7, 8 and 9 are front orthographic views illustrating coacting pairs of jack support heads for use with the jacks, as utilized with my present invention.
Figure 5:
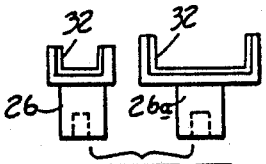
Figure 6:
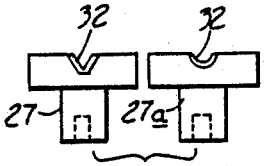
Figure 7:
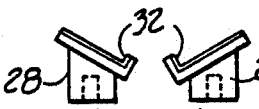
Figure 8:
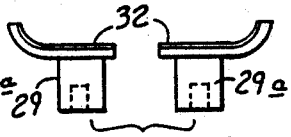
Figure 9:
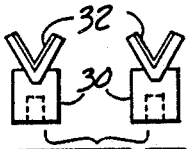
Figure 10:
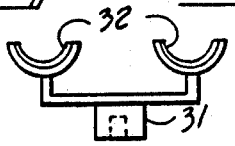
FIG. 10 is a front orthographic view of a single lift and support head that may be used with a single central jack positionable within a medial location on my mobile support structure.

Reference to FIG. 2 illustrates a recessed compartment 21 positioned at a forward portion of rearward support base 12 that is fully exposed when said respective base members 11 and 12 are in their fully extended positioned, as illustrated per FIG. 2. A ribbed upstanding perimeter 22 is positioned somewhat centrally of compartment 21 for accommodation of a jack support base 23 of jack member 24 that is normally stored in compartment 21, as illustrated. When deemed necessary, jack 24 may be positioned in an upright disposition within a perimeter 22 for a further centrally positioned jack that may be utilized independently or in a complementary fashion with jacks 19 in accommodating various objects o unique physical configuration. Storage of jack 24 within compartment 21 is accomplished by positioning of jack 24, as illustrated in FIG. 2, and merely extending piston 24*a* such that the jack is not free to move or relocate itself during normal use of my plural jack apparatus 10.

FIGS. 4 through 10 illustrate a series of head portions 25, 25*a*, 26, 26*a*, 27, 27*a*, 28, 28*a*, 29, 29*a*, 30, and a unitary head support device 31. These various elements are utilized in combination with jacks 19 and 24 in a combination of various configurational shapes to be supported by my apparatus. Of optional use with support heads 25 through 31 are rubber-like support cushions 32 secured within inner surfaces of the aforenoted support heads for a non-slip, non-marring support of various mechanical objects.

As to the manner of usage and operation of the present invention, the same should be apparent from the above description. Accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents my be resorted to, falling within the scope of the invention.

What is claimed as being new and desired to be protected by LETTERS PATENT of the United States is as follows:

1. A plural jack support apparatus for providing mobile, underlying support of mechanical objects comprising:

a forward and rear relatively movable support base securable in a locked relationship, and forward and rear jack support recesses positioned on said respective forward and rear support base, and first and second extensible and retractable jack support means positionable within said respective forward and rear jack support recesses, and a pair of wheels secured to said forward support base and a pair of wheels secured to said rearward support base, and a handle means secured in a forward portion of said forward support base wherein said plural jack apparatus is maneuverable by means of said handle and mobile by means of said attached wheels for selective positioning of said apparatus to an underlying position of a mechanical object for support thereof by use of said jack members, and wherein a recessed compartment is formed within said rearward support base, and a third jack support means is positionable in a first horizontal position in said compartment not extending above said rear support base's upper surface, and said third jack support means positionable in a second vertical working position for extending and retracting a piston associated with said third jack support means for support of various mechanical objects in cooperative relationship with said first and second jack support means.

2. A jack support apparatus as set forth in claim 1 wherein said third jack support means is positionable within a upstanding perimeter formed in such compartment.

3. Jack support apparatus as set forth in claim 1 wherein a plurality of head support members are positionable on said first, second and third jack support means for support of various mechanical objects 4. A jack support apparatus as set forth in claim 1 wherein said forward support base accommodates said rearward support base in a telescoping relationship.

5. A plural jack apparatus as set forth in claim 4 wherein said forward support base and said rearward support base are securable and lockable in a pre-selected position by means of alignment openings formed on said respective forward and rearward support bases in cooperation with a detend pin to maintain the alignment openings in a registered and aligned position.

* * * * *